US007367520B2

(12) United States Patent
Neveu

(10) Patent No.: US 7,367,520 B2
(45) Date of Patent: May 6, 2008

(54) CONTROLLED DISPENSING ROLL

(75) Inventor: Jean-Louis Neveu, Colmar (FR)

(73) Assignee: Georgia-Pacific France (FR)

( * ) Notice: Subject to any disclaimer, the term of this patent is extended or adjusted under 35 U.S.C. 154(b) by 0 days.

(21) Appl. No.: 10/597,877

(22) PCT Filed: Mar. 4, 2005

(86) PCT No.: PCT/FR2005/000527

§ 371 (c)(1),
(2), (4) Date: Aug. 10, 2006

(87) PCT Pub. No.: WO2005/084508

PCT Pub. Date: Sep. 15, 2005

(65) Prior Publication Data

US 2007/0063091 A1 Mar. 22, 2007

(30) Foreign Application Priority Data

Mar. 5, 2004 (FR) ..... 04 02338

(51) Int. Cl.
*B65H 18/28* (2006.01)

(52) U.S. Cl. ..... 242/160.1

(58) Field of Classification Search ..... 242/159, 242/160.1, 423, 423.1
See application file for complete search history.

(56) References Cited

U.S. PATENT DOCUMENTS

| | | | |
|---|---|---|---|
| 2,780,352 | A * | 2/1957 | Schroeder |
| 5,415,357 | A | 5/1995 | Smith |
| 5,474,249 | A * | 12/1995 | Koizumi et al. |
| 5,725,169 | A * | 3/1998 | Odagiri |
| 5,799,577 | A | 9/1998 | Takahashi |
| 6,179,235 | B1 | 1/2001 | King |
| 6,257,410 | B1 | 7/2001 | Ulmann et al. |
| 6,511,573 | B1 * | 1/2003 | Globensky et al. |

FOREIGN PATENT DOCUMENTS

| | | |
|---|---|---|
| GB | 704397 A | 2/1954 |
| GB | 2101084 A | 1/1983 |

* cited by examiner

*Primary Examiner*—William A Rivera

(57) ABSTRACT

This invention relates to paper rolls for sanitary or home use intended to operate in conjunction with a dispensing system. According to one essential feature of the invention, the roll includes internally a means intended to brake its unwinding. Thus, the consumption of paper may be controlled.

13 Claims, 3 Drawing Sheets

CONTROLLED DISPENSING ROLL

This invention relates to the field of single-use absorbent paper rolls used especially by the general public or at institutional facilities and known under such names as hygienic paper, toweling rolls, general wiping rolls, and also as hand towel rolls.

It is important at institutional facilities to be able to control the consumption of paper when these rolls are used and to limit the consumption so as to reduce the cost of consumables.

The concept of "cost in use" (cost at consumption) is very important for the buyer and numerous systems have been developed to dispense just the amount of paper needed by the user (the sheet-by-sheet system, for example).

Most frequently the product is placed in a dispenser that protects the roll and that is also capable of controlling the dispensing of the roll by limiting, for example, the undue unwinding of the roll. Braking is especially important for large-diameter toilet paper rolls whose over-consumption results in high costs. Another disadvantage related to the undue unwinding of the rolls is the risk of clogging the pipes when an excessively large amount of paper is thrown into the toilets.

As is known in the prior art, the dispenser may itself be fitted with braking means that may act on the roll to prevent it from unwinding too easily. For example, the upper part (or the hood) of the dispenser, by resting partially on the roll, simultaneously ensures the braking thereof.

For purposes of illustration, GB 2 101 084 discloses a dispenser fitted with a horizontal braking bar, having a special shape and acting on the external side of the roll.

U.S. Pat. No. 5,415,357 discloses a braking system that is added onto the roll at its tube.

Thus, the known systems are external to the roll. These are additional pieces that must be fitted onto the dispenser itself and which furthermore operate only with a specific dispenser.

The difficulty here resides in the fact that the system must be able to operate in conjunction with different types of paper having different features: single-ply, two-ply, pre-cut or non pre-cut sheets.

With these conditions, the reliability of the known dispensing systems is less than optimal and varies depending on the type of paper used, which may result in problems for the customer-user.

The object of the invention is to mitigate in particular the disadvantages mentioned above by providing rolls whose unwinding is controlled by the incorporation of a braking device in each roll.

Thus, it will no longer be necessary to use a special dispenser, and the invention may be applied to all types of rolls and paper.

Preferably, the subject matter of the invention is a paper roll for sanitary or home use intended to operate in conjunction with a dispensing system and comprising internally a means intended for braking the unwinding of the roll.

According to the invention, the braking means is comprised of at least one layer of adhesive material deposited on at least one of the sides of the roll.

Preferably, the layer covers at least 15% of the surface of at least one of the sides of the roll.

According to a preferred embodiment of the invention, the layer is deposited by printing, preferably by means of pad printing.

According to other different embodiments, the adhesive layer may be deposited according to a regular pattern of points, a continuous or line pattern, or a pattern comprising simultaneously point zones and continuous or line zones.

The invention also relates to a process for manufacturing a roll according to which, after forming of the roll, a layer of adhesive material is applied to at least one of its sides in such a way that it partially penetrates into the interior of the spires.

The invention will be better understood upon reading the description that follows, which is provided for purposes of illustration but in no way of limitation, with reference to the attached drawings in which.

Figure 4:
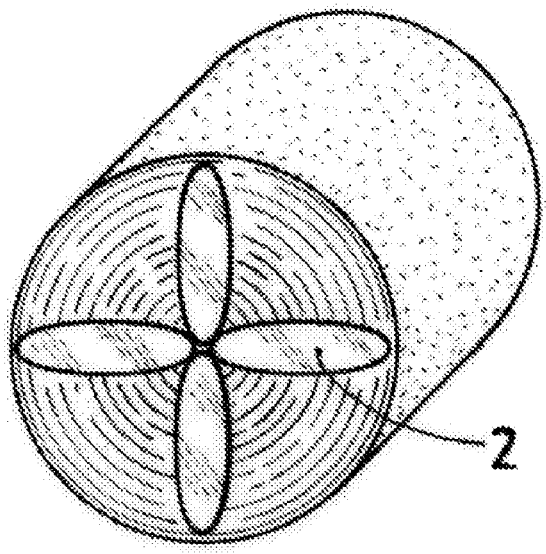
Figure 5:
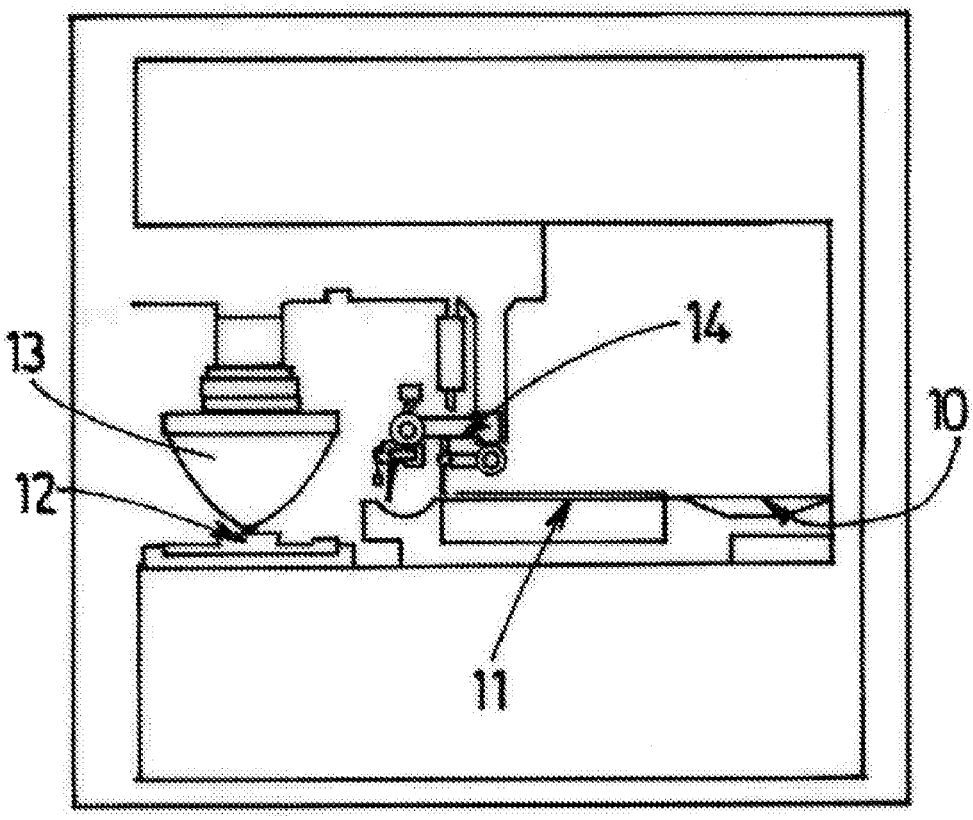

FIG. 4 refers to a fourth embodiment of the invention;

FIG. 5 is a diagram of a pad printing installation; and

Figure 6:
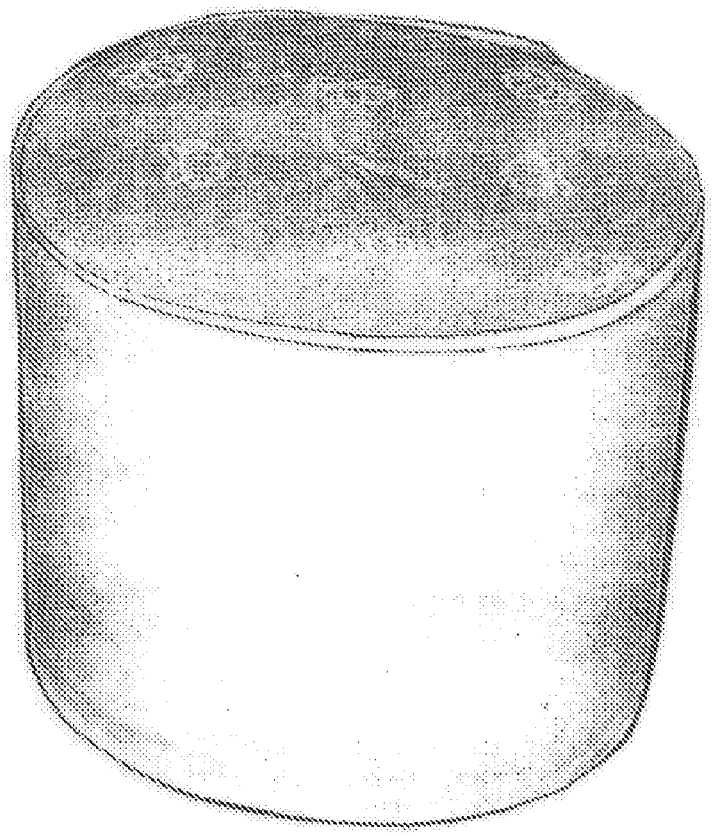
Figure 7:
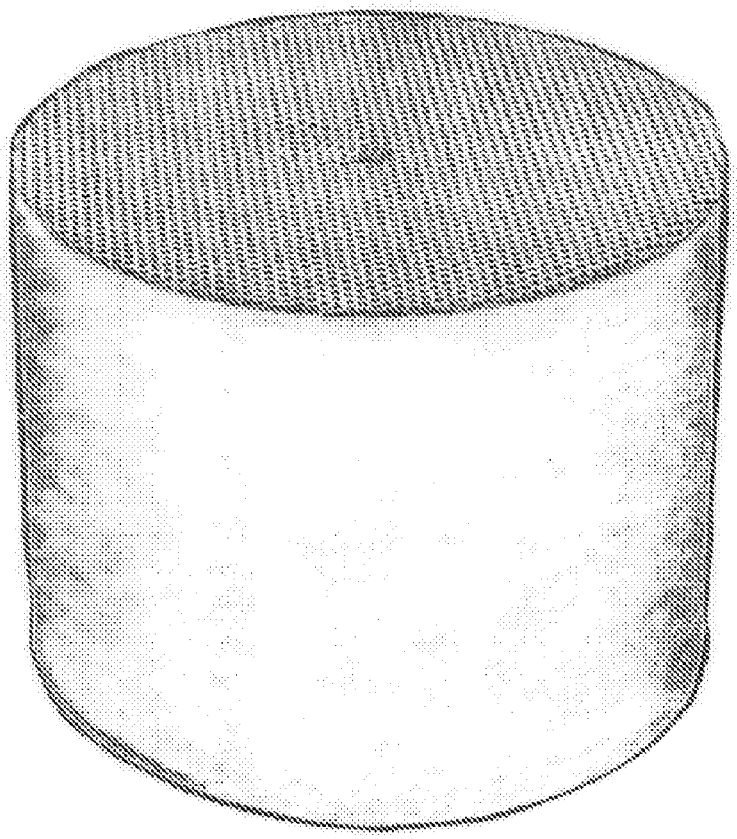

FIGS. 6 and 7 are photos of rolls according to the invention.

In all cases of the embodiments shown in the drawings, an adhesive is deposited on at least one of the sides of the roll in such a way as to ensure a sufficient bonding of the windings of the roll so as to prevent the self-unrolling of the paper. The roll in fact is "self-braked" by means of the incorporation of this adhesive.

Thus, the roll as claimed for the invention fulfills a dual function: a certain braking when the user unwinds the roll in a normal manner, and most importantly, it prevents an excessive unwinding of the roll when the user pulls abruptly on the paper and releases it. The paper then unwinds by itself around the roll and does not unwind any more.

The nature of the adhesive and the means of depositing it are such that the sheets of the roll may be detached without being torn when the user uses the roll, the bonding agent ensuring that the braking is limited to the external part of the windings.

The adhesive employed may be utilized in liquid form: in this case the quantity deposited and the viscosity of this adhesive will be adjusted in such a way that the braking is possible without causing the tearing of the paper at the time when it is dispensed.

The adhesive may preferably be an aqueous compound in the form of a solution or emulsion.

Different glues of this type have been used satisfactorily.

The adhesive used may also be in solid form and applied hot (product known under the name of "Hot Melt" a solid product is melted down under the effect of the temperature, then pulverized under the effect of a certain pressure).

Depending on the nature of the adhesive and on its form, the application thereof may be done by any known means such as:

pulverization;

fiberization;

impregnation;

printing.

According to a preferred embodiment of the invention, the layer is deposited by printing, in particular by means of pad printing.

As illustrated in FIG. 5, pad printing is a printing technique that enables the transfer onto a given support by means of a moldable pad of a defined pattern contained in a previously inked stereotype plate. Specifically, pad printing consists primarily of transferring the ink initially contained in a reserve tank 10 in the recessed relief of a stereotype plate 11 itself obtained by chemical photogravure and this thanks to a scraper 14.

The depositing of the pattern engraved in the stereotype plate onto an object 12 whose surface is not necessarily flat is carried out by removing the ink contained in the recesses of the plate by a pad 13, most of the time made of silicone, which proceeds to transfer this ink by contact and molding onto the object 12.

The use of such pads offers the advantage in particular of printing on non-flat, convex, concave or irregular surfaces.

Numerous industrial applications of this technique are known today: switches, electronic components, compact discs, toys, advertising as well as medical items, flasks, syringes, and packaging for pharmaceuticals.

In these applications, pad printing makes it possible to decorate and to make the objects more attractive.

Innovatively and inventively, this technique is preferably used to apply a layer of glue onto at least one of the sides of a paper roll.

The quantity of adhesive deposited may vary depending on the diameter of the roll, so as to ensure continuous braking during the normal unwinding of the paper.

Figure 1:
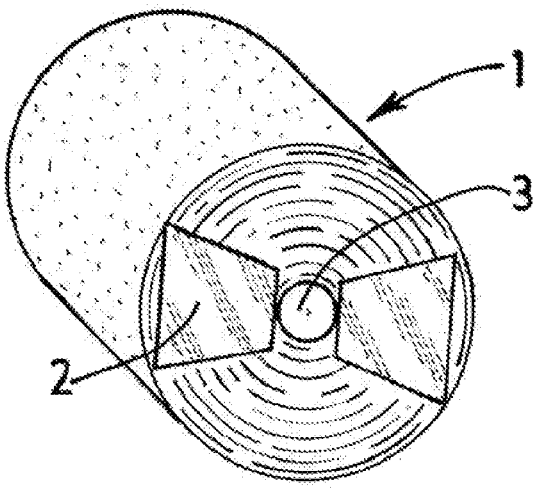
FIG. 1 is a simplified diagram of the first embodiment of the invention.
Figure 2:
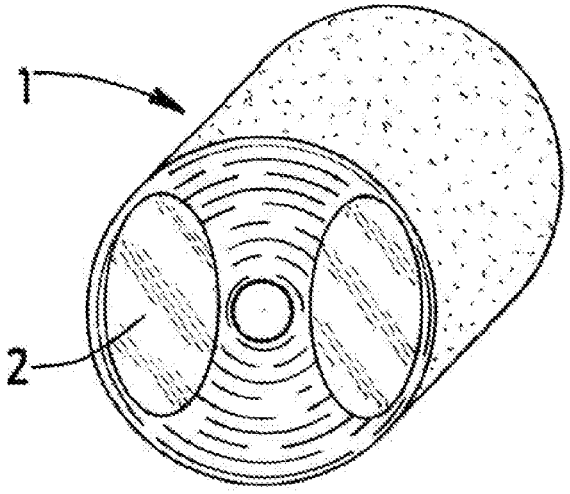
FIG. 2 is a simple diagram of the second embodiment of the invention.
Figure 3:
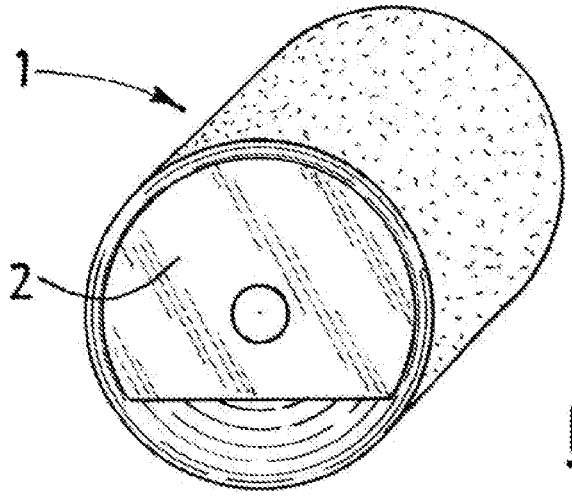
FIG. 3 shows a third embodiment of the invention.

FIGS. 1 to 3 show several embodiments of rolls as claimed for the invention, without however limiting the scope of the invention.

FIG. 1 represents a roll 1 fitted onto one of its sides with two zones covered with an "adhesive" 2, arranged symmetrically, each one in the form of a trapezoid.

FIG. 2, the two zones covered with adhesive 2 are oval, whereas in FIG. 3 a single zone 2 is provided.

FIG. 4 illustrates another embodiment of the invention according to which four zones 2 of the side of the roll are glued together. They are arranged approximately according to two diameters at a right angle. The system with this arrangement results in a smoother braking of the roll.

In all cases, the covered surface represents at least 15% of the total surface of the side.

Additionally, deposition of the glue may be done by points, discontinuously or continuously. The nature of the glue as well as the manner in which it is to be deposited will determine the type of deposition.

Preferably, the deposition of the glue is done even if the surface of the side is not very smooth and exhibits several flaws, as in the case of objects with irregular surface conditions. Pad printing is well suited for these types of depositions.

Furthermore, the presence of the adhesive layer on the side of the roll reinforces the resistance to the deformation of the roll 1 itself, thus increasing its rigidity, which is significant for its subsequent packaging.

In the case of rolls without a tube it has been found to be advantageous that the layer 2 as claimed for the invention reduces the risks of the crushing of the central hole 3 of the roll.

Additionally, the presence of the layer 2 changes the friction coefficient of the side of the roll. Depending on the nature of the glue and of the method of deposition, a supplementary braking may be obtained by contact of the side with an external means of braking.

Thus, if a roll as claimed for the invention is brought into contact with another external means, a supplementary braking may be effected.

Preferably a coloring agent is added to the glue thus making it possible to form decorative and/or advertising drawings, logos, etc., on at least one of the sides of the roll: FIG. 6 illustrates an example of such an application.

By way of illustration, but in no way of limitation, some glue SWIFT Ref. L. 998/4 (Registered Trademark) has been used. It is an aqueous solution of synthetic polymers containing approximately 18% of dry extract. The viscosity obtained for the non-diluted glue (commercial solution) and glue diluted with 20% and 50% of water were 25000, 8000, and 600 centipoises, respectively.

The glue used may be scented or may even have a bactericide added to it in order to add a supplemental function to the roll as claimed for the invention.

FIG. 7 is a photo that shows an embodiment of the invention according to which the deposition of the layer of adhesive material is done by points in accordance with a regular grid pattern.

The invention claimed is:

1. A paper roll for operation in conjunction with a dispensing system, comprising braking means internal of said roll arranged to brake unwinding of said roll wherein said braking means comprises at least one layer of adhesive material deposited on at least one side of the roll covering at least 15% of a surface of said at least one side.

2. The roll as claimed in claim 1, wherein said at least one layer is deposited by printing.

3. The roll as claimed in claim 2, wherein the at least one layer of adhesive material is deposited according to a regular pattern of points.

4. The roll as claimed in 2, wherein the at least one layer of adhesive material is deposited according to a continuous pattern.

5. The roll as claimed in claim 2, wherein the at least one layer of adhesive material is deposited according to a pattern comprising point zones and continuous zones.

6. The roll as claimed in claim 2, wherein said at least one layer is deposited by pad printing.

7. The roll as claimed in claim 6, wherein the at least one layer of adhesive material is deposited according to a pattern comprising point zones and continuous zones.

8. The roll as claimed in claim 6, wherein the at least one layer of adhesive material is deposited according to a continuous pattern.

9. The roll as claimed in claim 6, wherein the at least one layer of adhesive material is deposited according to a regular pattern of points.

10. A manufacturing process for a paper roll comprising forming the roll, applying at least one layer of adhesive material to at least one side of said roll in such a way that said at least one layer covers at least 15% of the area said at least one side of said roll and partially penetrates interiorly of a winding of the roll.

11. The process as claimed in claim 10 wherein the adhesive material is an aqueous compound.

12. The process as claimed in claim 10, further comprising depositing said at least one layer by printing.

13. The process as claimed in claim 12 wherein the adhesive material is an aqueous compound.

* * * * *